US006518942B1

(12) United States Patent
Kurganov

(10) Patent No.: US 6,518,942 B1
(45) Date of Patent: Feb. 11, 2003

(54) METHOD OF FORMING THE IMAGES IN THE SYSTEMS HAVING OBJECTS MOVING RELATIVE TO EACH OTHER

(76) Inventor: Igor P. Kurganov, Pr. Volgogradsky, 69-124, Moscow 109125 (RU)

( * ) Notice: Subject to any disclaimer, the term of this patent is extended or adjusted under 35 U.S.C. 154(b) by 0 days.

(21) Appl. No.: 09/582,249

(22) PCT Filed: Dec. 30, 1997

(86) PCT No.: PCT/RU97/00427

§ 371 (c)(1),
(2), (4) Date: Jun. 22, 2000

(87) PCT Pub. No.: WO99/34349

PCT Pub. Date: Jul. 8, 1999

(51) Int. Cl.[7] ..... G09G 3/20
(52) U.S. Cl. ..... 345/56; 345/61
(58) Field of Search ..... 345/55, 56, 59, 345/60, 61

(56) References Cited

U.S. PATENT DOCUMENTS 5,650,794 A * 7/1997 Walsh ..... 345/56
6,072,446 A * 6/2000 Tokimoto ..... 345/56

* cited by examiner

*Primary Examiner*—Matthew Luu
(74) *Attorney, Agent, or Firm*—Notaro & Michalos P.C.

(57) ABSTRACT

The invention relates to the field of forming the images in the systems having objects moving relative to each other. Particularly, it can be used at the transport and in the building for advertisement, designer, entertainment purposes and the like, thereby providing a simple execution. The method comprises of that an each image frame being formed by scanning with a separate image forming devices, and each frame scanning beginning of the formed image being synchronized with a moment when an object receiving the visual information comes into the visibility zone of the separate image forming devices while a mutual moving of said object and image forming devices. The technical result is achieved due to each frame of the formed image being divided in advance into equal fragments each consisting of one or more image elements disposed along the direction of the mutual moving of the object receiving the visual information, an emitter matrix being used as each one of image forming devices, having dimensions corresponding to dimensions of said one fragment, each image frame being formed by scanning it with the corresponding emitter matrix, and a rate of the frame scanning by each emitter matrix being selected so as all fragments consisting this frame to be lit sequentially by this emitter matrix at least one time till this emitter matrix is in the visibility zone of the object receiving the visual information.

2 Claims, 2 Drawing Sheets

Invention: "Method for forming images in systems having objects moving relative to each other"

Invention:"Method for forming images in systems having objects moving relative to each other".

METHOD OF FORMING THE IMAGES IN THE SYSTEMS HAVING OBJECTS MOVING RELATIVE TO EACH OTHER

This application is a 371 of PCT/RU97/00427 filed Dec. 30, 1997.

FIELD OF THE INVENTION

This invention relates to the field of forming images in the systems having objects moving relative to each other and can be used, particularly, at the transport and in the building for advertisement, designer, entertainment purposes and the like.

BACKGROUND OF THE INVENTION

At present, various methods for forming images in the systems having objects moving relative to each other are known. For example, in GB 1459021 A (G 09 F 19/12, 1976) is disclosed a method for forming images at the railway transport, wherein each image frame is lit up by a motionless projector while a train being passed within its visibility zone. The disadvantage of this method is a great labor-intensiveness of the image change, since in this case it is necessary to change all the lit up frames.

In RU 95104128 A1 (G 09 F 19/12, 1997) is described a method for forming images, wherein each image frame is formed by scanning with a separate image forming device, each of which being mounted motionless relative to other image forming devices, and by synchronizing each frame scanning beginning with a moment when an object receiving the visual information comes into the visibility zone of the separate image forming device, while said object and image forming devices having a relative movement. This method allows to simplify a step of changing the formed images because it provides a possibility to switch them in each image forming device, or to send corresponding frames to each of those image forming devices. However, it is difficult to realize this method, since it requires a television, i.e. line-by-line, scanning of each frame by each image forming device on a special screen in the window of the moving object.

Thus, there is a need to create such method for forming images in the systems having objects moving relative to each other, which would be free from the indicated disadvantages, or, in other words, which would be simple enough to be realized.

SUMMARY OF THE INVENTION

In order to solve the raised problem in a method for forming images in the systems having objects moving relative to each other, comprising steps of: forming each image frame by scanning with a separate image forming device, each of which is mounted motionless relative to other image forming devices, and synchronizing each frame scanning beginning with a moment when an object receiving the visual information comes into the visibility zone of the separate image forming device, while said object and image forming devices have a relative movement, according to the present invention, the method further comprises a step of dividing in advance each frame of the formed image into equal fragments each consisting of one or more image elements disposed along the direction of the relative movement of the object receiving the visual information, a matrix of emitters is used as each one of image forming devices, which matrix dimensions correspond to dimensions of said one fragment, the step of forming each frame is performed by scanning it with the corresponding matrix of emitters, and a rate of the frame scanning by each matrix of emitters is selected so as to light up sequentially all fragments consisting this frame by this matrix of emitters at least one time till this matrix of emitters is in the visibility zone of the object receiving the visual information.

In so doing, the scanning of each of said frames is performed by the matrix of emitters corresponding to this frame.

No objects have been founded in the background having such set of essential limitations, which allows to consider the proposed method as novel.

Methods for forming an image using its fragment-by-fragment scanning by a matrix of emitters are known, for example, from JP 06-214509 A (G 09 F 9/30, 1994). However, no mention of the entire above set of distinctions of the proposed method have been found in the known information sources, which allows to consider the proposed method as having the inventive step.

BRIEF DESCRIPTION OF THE DRAWINGS

The invention is illustrated by the drawings, in which.

DETAILED DESCRIPTION OF EMBODIMENTS OF THE INVENTION

Figure 1:
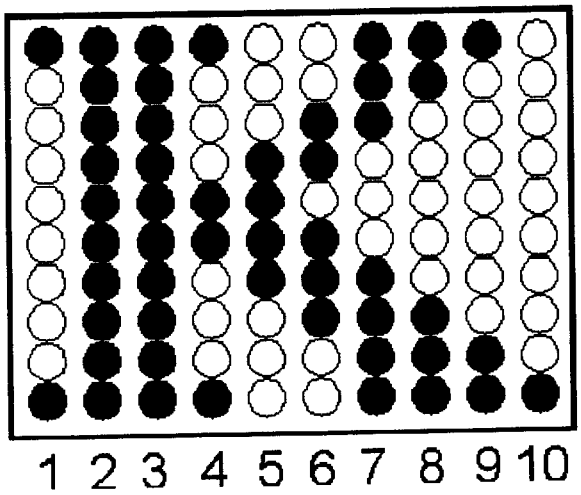
FIG. 1 depicts a division of an image into fragments.

FIG. 1 represents an element-by-element division of one image frame. A relative movement of an object receiving the visual information (for example, a spectator in a train car) and an image forming device is assumed to occur in the horizontal plane. Therefore, the image frame shown in FIG. 1 is divided into vertical elements 1 to 10. In the case, when the relative movement of the object receiving the visual information and the image forming device occurs in the vertical plane (for example, while moving a lift car), the image will be divided into horizontal elements. In any case, all elements have the same size.

The reason of this is that any such element could be reproduced by the same image forming device. As such device, in the proposed method is used a matrix of emitters, which height (in the case of the horizontal direction of the above relative movement) corresponds to the height of each image element. A matrix width can be equal to a width of one image element, but also can be equal to a width of several (for example, two) image elements standing adjacently. Thus, a size of the matrix of emitters corresponds to a size of the image fragment which can consist of one or more image elements.

Figure 2:
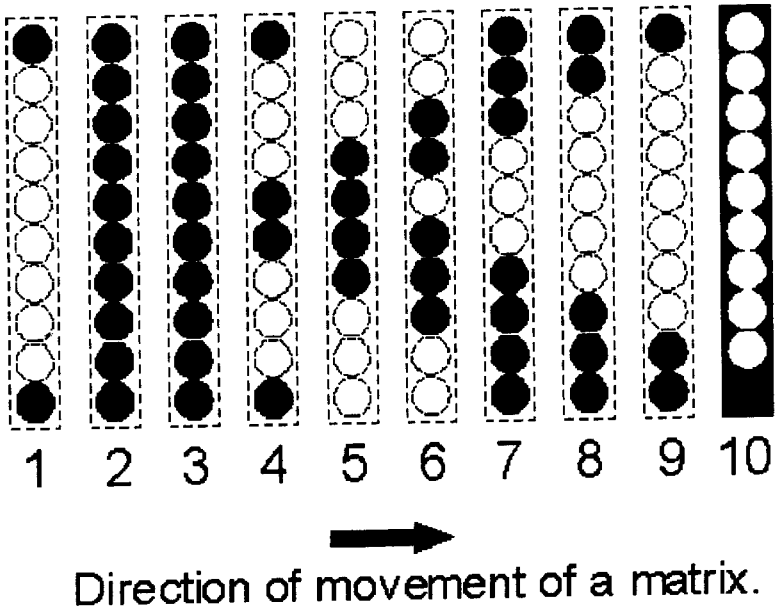
FIG. 2 illustrates the process of forming image while an object receiving the visual information and a matrix of emitters have a relative movement.

In the case of the relative movement of such matrix of emitters and the object receiving the visual information (see FIG. 2), the matrix emitters lights up sequentially separate fragments of the whole image. If the image fragment consists only from one image element, the matrix of emitters lights up sequentially those image elements 1 to 10 one by one. If the image fragment consists, for example, from two image elements, the matrix of emitters will light up simultaneously two adjacent image elements (for example, 1 and 2), then two next elements (3 and 4) and so on. However, the variant is not excluded, when each possible pair of elements is lit up, i.e., first, the elements 1 and 2, then the elements 2 and 3, then the elements 3 and 4, and so on. A choice of the specific variant of lighting up the image fragments is defined first of all by a rate of the relative movement of the matrix of emitters and object receiving the visual information. In so doing, the direction of lighting up (i.e., from the element 1 to the element 10, or from the element 10 to the element 1) is of no importance, since the process of lighting the fragments occurs quick enough for the eye of an observer to sense not separate fragments lit up, but the whole image. It is also of no importance, how many times the matrix of emitters will light up the whole image, but it is important only to light up that image entirely at least once during the period, when the object receiving the visual information is in the visibility zone of this matrix of emitters.

Figure 3:
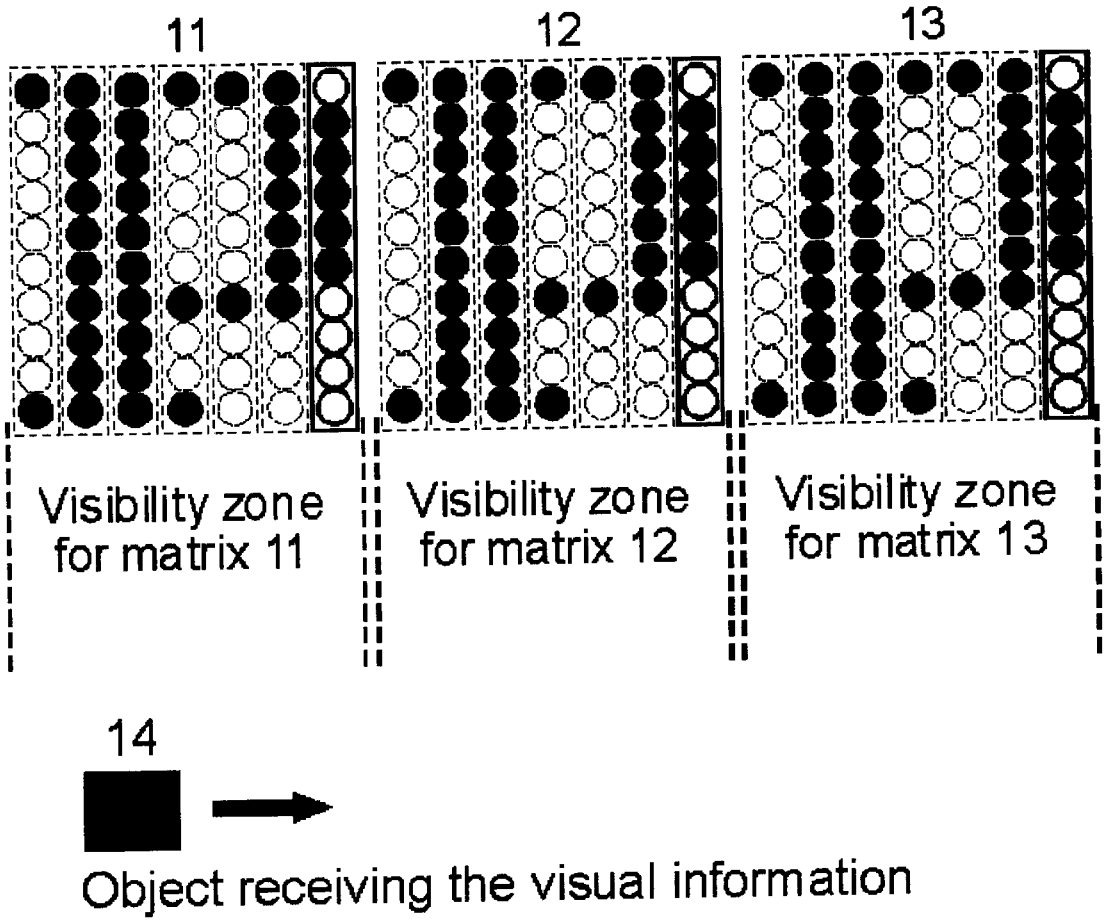
FIG. 3 shows the process of forming a multiframe image while an object receiving the visual information and a matrix of emitters have a relative movement.

FIG. 3 illustrates the process of forming a multiframe image while the object 14 receiving the visual information (the observer in a train car) has a movement past several (three in this case) matrices 11 to 13 of emitters. All those matrices 11 to 13 are the same and have similar visibility zones. Operation of each of matrices 11 to 13 begins at the moment, when the object 14 receiving the visual information comes into the visibility zone of this matrix of emitters. At that moment the corresponding matrix of emitters (in this case, the matrix 11 in FIG. 3) begins to light up sequentially fragments of its image frame, as it is described above for FIG. 2. When the object 14 receiving the visual information leaves the bounds of the visibility zone of the first matrix 11 of emitters, this matrix 11 stops to light up fragments. As soon as the object 14 comes into the visibility zone of the next matrix of emitters (in this case, it is the second matrix 12 of emitters), this matrix 12 begins to light up the frame.

Adjacent matrices of emitters can light up both image frames differed from one another and similar frames (as shown, for example, in FIG. 3). A number of matrices of emitters lit up the same image frame is defined by a common number of image frames, common number of matrices of emitters in the system, and rate of relative movement of matrices of emitters and object receiving the visual information.

Matrix emitters can be made, for example, in the form of light emitting diodes, lasers and other emitting devices. The matrix can be made using only one emitter (for example, a gas-filled tube), before which there are a row (rows) of holes opened by mechanical or optoelectronics shutters. A specific form of matrices of emitters has no importance and does not enters the scope of claims of this patent application.

In equivalent manner, this scope of claims does not include a specific embodiment of means for synchronizing the process of lighting up the frame by a separate matrix of emitters with the moment when the object receiving the visual information comes into its visibility zone. Those means may have any embodiment providing the needed synchronization, particularly, such means can be similar to those disclosed in the above-mentioned GB 1459021 A (G 09 F 19/12, 1976).

INDUSTRIAL APPLICABILITY

As indicated above, the proposed method can be used in the transport, especially in tunnels, particularly in a metro, as well as in lifts, for example, in highrise buildings. Thus, the proposed method may be considered as having industrial applicability.

The above description of the proposed method serves only for its illustration but not limitation. For those skilled in the art it will become clear that a specific embodiment of one or another feature of the proposed method can be anyone, if it provides the corresponding function performed by that feature. Therefore, the scope of patent claims is defined not by the description, but by the enclosed Claims.

What is claimed is:

1. A method for forming images in systems having objects moving relative to each other, including steps of:

forming each image frame by scanning with a separate image forming device, each of which is mounted motionless relative to other image forming devices, and synchronizing each frame scanning beginning with a moment when an object receiving the visual information comes into the visibility zone of the separate image forming device, while said object and image forming devices have a relative movement, characterized in that the method further comprises a step of dividing in advance each frame of the formed image into equal fragments each consisting of one or more image elements disposed along the direction of said relative movement of the object receiving the visual information, a matrix of emitters is used as each one of said image forming devices, which matrix dimensions correspond to dimensions of said one fragment, the step of forming each frame is performed by scanning that frame with the corresponding matrix of emitters, and a rate of the frame scanning by each matrix of emitters is selected so as to light up sequentially all fragments consisting said frame by said matrix of emitters at least one time till said matrix of emitters is in the visibility zone of said object receiving the visual information.

2. The method according to claim 1, characterized in that the scanning of each of said frames is performed by the matrix of emitters corresponding to this frame.

* * * * *